United States Patent [19]

Chich

[11] Patent Number: 4,948,004

[45] Date of Patent: Aug. 14, 1990

[54] REFUSE CONTAINER

[75] Inventor: Robert H. Chich, Mequon, Wis.

[73] Assignee: DCI Marketing, Milwaukee, Wis.

[21] Appl. No.: 327,005

[22] Filed: Mar. 22, 1989

[51] Int. Cl.[5] ..... B65D 25/00

[52] U.S. Cl. ..... 220/1 T; 220/404

[58] Field of Search ..... 220/1 T, 23.83, 23.86, 220/404

[56] References Cited

U.S. PATENT DOCUMENTS

| | | | |
|---|---|---|---|
| 3,309,160 | 3/1967 | Lewis | 220/1 T X |
| 3,658,233 | 4/1972 | Voytko | 220/1 T X |
| 3,684,155 | 8/1972 | Smith | 220/404 |
| 3,825,150 | 7/1974 | Taylor | 220/404 |
| 4,143,792 | 3/1979 | Rex | 220/23.86 X |
| 4,483,440 | 11/1984 | Ware | 220/404 X |

*Primary Examiner*—Steven M. Pollard

*Attorney, Agent, or Firm*—Michael, Best & Friedrich

[57] ABSTRACT

A refuse container for positioning a replaceable bag in a predetermined operative attitude including, a sidewall defining a mouth, and a puncturing member is defined by the sidewall and disposed in close proximity to the mouth, the puncturing member operable to pierce the bag thereby securing the bag in the predetermined operative attitude.

15 Claims, 2 Drawing Sheets

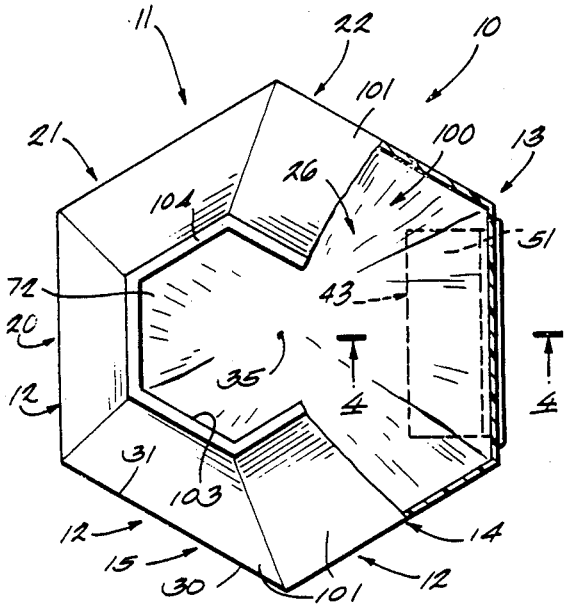
Fig. 3
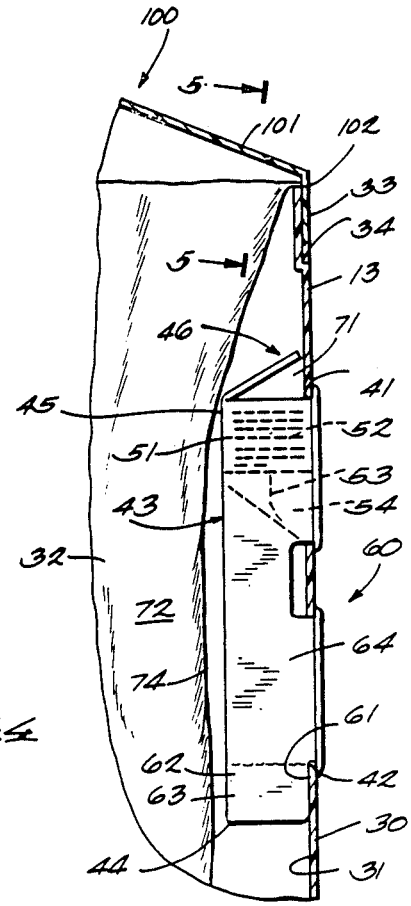
Fig. 4
Fig. 5
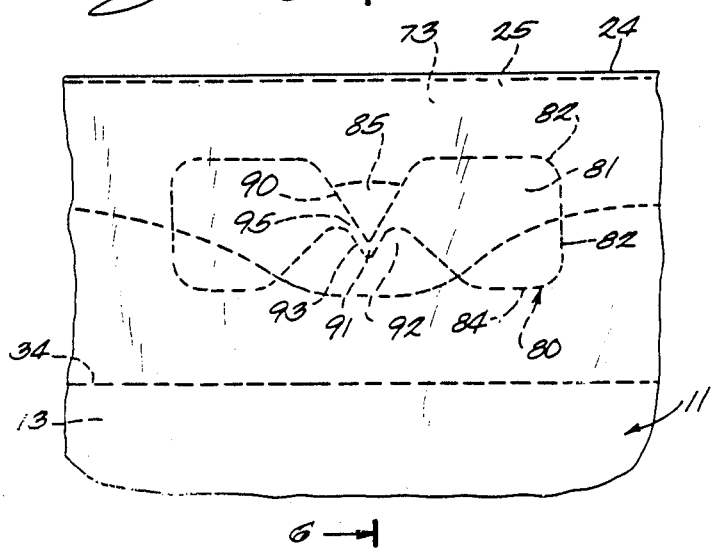
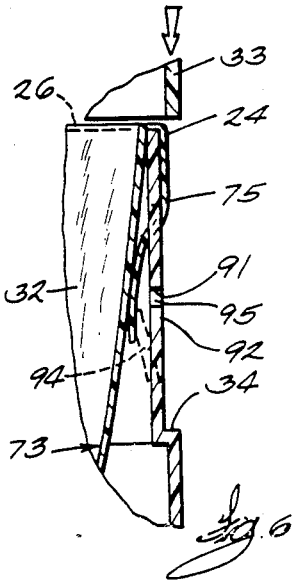
Fig. 6

REFUSE CONTAINER

BACKGROUND OF THE INVENTION

1. Field of the Invention:

The present invention relates to a refuse container and the like, and more particularly to such a refuse container which is operable dependably to secure a replaceable bag in a predetermined operational attitude while serving a variety of other functions.

2. Description of the Prior Art:

The problems related to the corrosive deterioration of refuse containers due to the damaging effects of repeated and prolonged exposure of the containers surfaces to corrosive liquids has long been known. The exterior and interior surfaces of these refuse containers, after prolonged exposure to water, petroleum products, and the like, tend to corrode, pit, and become weakened over the course of time, unless suitable preventive maintenance is practiced. Such corrosion-related damage further makes these refuse containers unsightly.

In those situations where refuse containers periodically receive caustic substances such as petroleum products, the cost of repair or replacement of the refuse containers can be substantial. For example, service station proprietors frequently utilize empty grease drums and the like for refuse containers because these containers are exposed daily to the effects of petroleum related products as well as to the elements, and therefore must be replaced on a regular basis. While utilizing these empty containers may provide a solution to the corrosion problem which is field expedient and cost effective, the containers frequently are unattractive and may be difficult to clean and maintain.

Attempts made in the prior art to protect the surfaces of refuse containers from corrosion-related damage have assumed various forms. For instance, many owners of refuse containers drill numerous drainage holes in the base of the containers to prevent the accumulation of corrosive liquids in the bottom of the container, or they will alternatively paint or otherwise apply various specially designed surface coatings which retard the development of corrosion-related damage.

Other attempts in the prior art to provide a protective device for the interior surfaces of a refuse container have included a wide variety of bag-like liners which are disposed internally of the refuse container and which receive the corrosive substances thereby protecting the interior surfaces from the corrosive effects of these substances.

While some of the prior art practices and devices have operated with varying degrees of success, they are often unsatisfactory in one or more respects. For example, some of these devices ar cumbersome, not reliably maintained in position, and often cannot be utilized in combination with all of the variously dimensioned refuse containers which are commercially available. Other devices or practices either do not cover or protect all of the exposed surface areas, periodically need to be reapplied to the interior surfaces of the refuse container, or are otherwise oversized and not convenient to employ. Moreover some of the devices are unattractive when utilized in environments having a particular decor.

Therefore it has long been known that it would be desirable to have a refuse container which is operable reliably to position a replaceable bag in a predetermined operative attitude thereby protecting the internal surfaces of the refuse container from corrosion related damage, and which further is inexpensive to manufacture and sell and characterized by ease of utilization.

OBJECTS AND SUMMARY OF THE INVENTION

Therefore, it is an object of the present invention to provide an improved refuse container and the like.

Another object of the present invention is to provide such a refuse container which is operable dependably to position a replaceable bag in a predetermined operative attitude and which substantially inhibits the replaceable bag from collapsing into the container upon receiving refuse.

Another object of the present invention is to provide such a refuse container which reliably positions a replaceable bag in such an attitude that corrosion related damage to the refuse container is substantially eliminated.

Another object of the present invention is to provide such a refuse container which includes a puncturing member operable to engage the replaceable bag so as to secure it in a predetermined operative attitude relative to the refuse container.

Another object of the present invention is to provide such a refuse container which is operable to dispense a source of paper towels, as well as a source of fluid, and which further is characterized by ease of deployment, simplicity of construction and which can be sold and maintained at a relatively nominal cost.

Further objects and advantages are to provide improved elements and arrangements thereof in a refuse container for the purposes described which is dependable, economical, durable and fully effective in accomplishing its intended purposes.

These are other objects and advantages are achieved in a refuse container wherein a vessel having a mouth is adapted to receive and hold a replaceable bag in a predetermined operational attitude, and the vessel includes a means for puncturing the replaceable bag thereby securing it in an operable attitude about the mouth of the vessel.

BRIEF DESCRIPTION OF THE DRAWINGS

FIG. 3 is a plan view of the refuse container of FIG. 1 with some supporting surfaces removed to show the structure below.

FIG. 4 is a fragmentary, longitudinal, vertical sectional view of the refuse container of the subject invention taken from a position along line 4—4 of FIG. 3.

FIG. 5 is a fragmentary, longitudinal, vertical sectional view of the refuse container of the subject invention taken from a position along line 5—5 of FIG. 4.

FIG. 6 is a fragmentary, longitudinal, vertical sectional view of the refuse container of the subject invention taken from a position along line 6—6 of FIG. 5 and showing the movement of the restraining member in phantom lines.

DESCRIPTION OF THE PREFERRED EMBODIMENT

Figure 1:
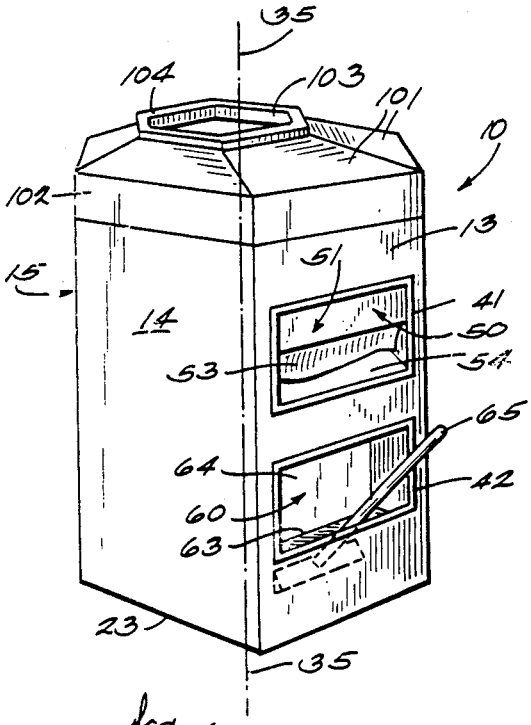
FIG. 1 is a perspective view of the refuse container embodying the principles of the present invention shown in a typical operative configuration.

Referring more particularly to the refuse container of the present invention is generally indicated by the numeral 10 in FIG. 1. The refuse container 10 has a substantially vertically disposed side wall, which is generally indicated by the numeral 11, and which includes a plurality of panels 12. As seen most clearly by reference to FIG. 3, the side wall appears generally hexagonal in shape when viewed in the plan perspective. The side wall 11 includes first, second, third, fourth, fifth, and sixth panels, the individual panels sequentially numbered 13, 14, 15, 20, 21 and 22 respectively. Each of the panels includes a first or earth-engaging end, 23, and a second end, 24, which defines a peripheral edge, 25. The individual peripheral edges, 25, of each of the panels, defines a generally upwardly disposed mouth, 26. Further, each panel has an outside surface, 30, and an opposite inside surface 31, the inside surfaces defining an internal cavity, 32, of predetermined dimensions. As best illustrated by reference to FIG. 2, a recessed area 33 is formed in the second end 24 of each of the panels. The recessed areas define a shelf or ledge 34 which circumscribes the outside surface 30. Further, the refuse container has a longitudinal axis which is generally indicated by the line labeled 35.

The first panel 13 has first and second openings, 41 and 42, respectively, formed therein. Further the refuse container 10 includes an interior wall, which is generally indicated by the numeral 43, and which has a first end 44 and second end 45. As best seen by reference to FIGS. 2 and 4, the second end 45 includes an angulated deflector 46 which is operable to deflect refuse into a particular area of the internal cavity 32. The operation of the deflector will be discussed in greater detail in the paragraphs which follow. As seen most clearly by reference to FIG. 2, a paper towel dispensing means, which is generally indicated by the numeral 50, is manufactured as an integral portion of the interior wall 43. The paper towel dispensing means includes a housing 51 that defines a cavity 52. The paper towel dispensing means is operable to dispense a plurality of towels 53 in a manner well understood by those skilled in the art. As seen most clearly by reference to FIG. 4, the housing 51 is operable slideably to be received through the first opening 41. The housing 51 has a dispensing opening 54 which permits easy access to the paper towels. The refuse container 10 further includes a fluid dispensing means which is generally indicated by the numeral 60, and which is also manufactured as an integral portion of the interior wall 43. As shown most clearly by reference to FIG. 2, the fluid dispensing means includes a bucket portion, 61, that defines a cavity 62 which holds a predetermined volume of windshield washing fluid 63. As illustrated most clearly by reference to FIG. 4, the bucket portion 61 includes a fluid dispensing opening 64 which is positioned in the second opening 42. As illustrated most clearly by reference to FIG. 1, the opening 64 is dimensioned so as to allow access by a windshield washing tool 65.

As most clearly illustrated by reference to FIG. 3, the interior wall 43 divides or otherwise separates the internal cavity 32 into a first and second Portion 71 and 72 respectively. As most clearly seen by reference to FIG. 4, the first portion of the internal cavity houses the paper towel dispensing means 50, and the fluid dispensing means 60 respectively. Further it should be understood that the angulated deflector 46 is operable substantially to occlude the first portion thereby preventing any refuse from reaching either assembly. A replaceable bag, which is generally indicated by the numeral 73, includes a substantially unitary and fluid-impervious wall 74. The wall 74 has a circumscribing edge 75 that defines a mouth 76.

As best illustrated by reference to FIG. 5 the refuse container 10 includes a puncturing means which is generally indicated by the numeral 80. The puncturing means is defined by an opening 81 which is disposed in close proximity to the second end 24 of the first and fourth panels 13 and 20 respectively. As clearly illustrated by reference to FIG. 2, the individual openings 81 are disposed in substantially equidistantly spaced relation, one to the other. Each of the openings 81 has a peripheral edge 82, which includes a top portion 83 and a bottom portion 84. As sen most clearly by reference to FIG. 5 the top portion of the peripheral edge defines a puncturing member 85 which has a substantially wedge-like shape. The puncturing member includes a pair of converging edges 90 which intersect at an apex 91. A restraining member 92 is defined by the bottom portion 84 of the peripheral edge 82. The restraining member includes a substantially wedge-like, or v-shaped channel which is substantially aligned with the puncturing member 85. the restraining member and the puncturing member are positioned centrally in the opening 81. That is, both the puncturing member and the restraining member are spaced inwardly from the opposed end portions of opening 81 leaving adequate space for manipulation of the replaceable bag during insertion and removal. As seen most clearly by reference to FIG. 6 the restraining member 92 is resiliently movable along a substantially arcuately-shaped path of travel 94. The restraining member normally assumes a position which is substantially in the plane of the sidewall 11, however, and when manual force is applied, the restraining member is movable along the arcuately-shaped path of travel, out of the plane of the sidewall thereby exposing the puncturing member such that the replaceable bag 73 can be moved into contact with the puncturing member, the puncturing member piercing the bag in the manner as most clearly shown by reference to FIG. 5. A narrow channel 95 is defined between the puncturing member and the restraining member.

A removable cover, which is generally indicated by the numeral 100, is disposed in occluding relation relative to the internal cavity 32. The cover 100 includes a plurality of panels 101 which are disposed in approximately the same hexagonal shape as the sidewall 11. Further, the plurality of panels 101 includes a vertical sidewall component 102 which is conformably dimensioned to be received in fitted mating receipt in the area defined by the recessed portion 33. This relationship is most clearly shown by reference to FIG. 4. The cover 100 is operable, when disposed in fitted receipt about the sidewall substantially to cover the individual puncturing means 80. This is also seen most clearly by reference to FIG. 4. The cover 100 includes an orifice 103 which is disposed in substantially non-coaxial alignment with the longitudinal axis 35. It should be understood that the orifice is positioned such that refuse passing through the orifice is directed into the second portion of the internal cavity 32. This is seen most clearly by reference to FIG. 3. The orifice is defined by a hardened edge member 104 which may be manufactured out of any suitable substance such as stainless steel or the like.

OPERATION

The operation of the described embodiment of the present invention is believed to be readily apparent and is briefly summarized at this point.

Figure 2:
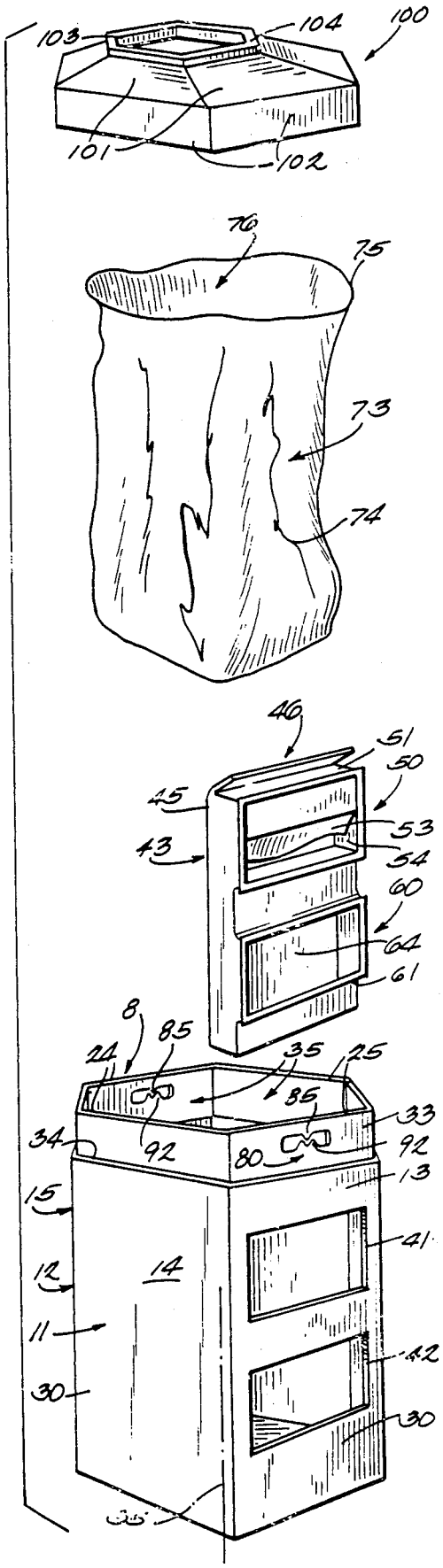
FIG. 2 is a perspective, exploded view of the refuse container embodying the principles of the present invention.

The refuse container 10 for positioning and securing a replaceable bag 73 in a predetermined operational attitude is most clearly shown by reference to FIGS. 2 and 5 respectively. As shown therein, and with the cover 100 removed, an individual can gain access to the second portion 72 of internal cavity 32 such that a replaceable bag, containing refuse, can be removed. After removing the bag, a suitable replacement bag is positioned in the second portion, and the mouth of the bag 76 is stretched, or otherwise positioned in covering relation about the peripheral edge 25, which defines the mouth 26 of the refuse container. Upon turning down the edge of the bag 75 as shown most clearly in FIG. 6, an operator would exert manual force on the restraining member 92 so as to cause it to move along the arcuately shaped path of travel 94 out of the plane of the sidewall 11. As earlier discussed, this movement permits the bag to be moved into engagement with the puncturing member 85.

It should be understood that when refuse is placed in the bag 73 the weight of the refuse has the effect of urging the edge of the bag 75 upwardly against the puncturing member 85 thereby, substantially inhibiting the release of the edge member 75 from the mouth 26 of the container. This action of course prevents the bag from falling or collapsing into the inside of the container. Further, the restraining member inhibits downward movement of the bag thereby preventing the disengagement of the bag from the puncturing member. To remove the bag, the bag material is pulled down off of the puncturing member and out of the opening 81. Then the entire bag, and contents, can be lifted out of the container.

Therefore, the refuse container of the present invention provides a reliable means for securing a replaceable bag or other similar device in a predetermined operative attitude and which simultaneously extends the life of the refuse container at a relatively nominal cost.

Although invention has been herein shown and described in what is conceived to be the most practical and preferred embodiment, it should be recognized that departures may be made therefrom within the scope of the invention which is not to be limited to the illustrated details disclosed.

Having described my invention, what I claim is new and desire to secure by Letters patent is:

1. A refuse container for securing a replaceable bag in a predetermined operative attitude comprising:

a vessel having a sidewall which defines an internal cavity, and a mouth;

means for puncturing the replaceable bag borne by the sidewall and disposed in close proximity to the mouth, the puncturing means securing the bag in a predetermined operative attitude relative to the internal cavity, said puncturing means including an opening formed in the sidewall and communicating with the internal cavity, said opening defined by a peripheral edge having spaced top and bottom portions and opposed, spaced apart end portions, said puncturing means also including a puncturing member defined by the top portion of the peripheral edge and disposed in substantially the same plane as the sidewall, the bottom portion of the peripheral edge defining a restraining member positioned in close proximity to the puncturing member and disposed in substantially the same plane as the sidewall, and said puncturing member and restraining member disposed substantially centrally in said opening and spaced inwardly of said opposed end portions of said opening.

2. The refuse container of claim 1 wherein said refuse container includes at least two puncturing means constructed and arranged as set forth in claim 1 and disposed in substantially equally spaced positions about the sidewall of the refuse container, and including a cover for said container covering the individual puncturing means when said cover is disposed in fitted receipt with said sidewall.

3. The refuse container of claim 1 wherein the puncturing member is substantially wedge shaped.

4. The refuse container of claim 3 wherein a passageway is defined between the puncturing member and the restraining member.

5. The refuse container of claim 3 wherein means for dispensing a source of paper towels is borne by the refuse container and disposed in the internal cavity, and including means for supporting said paper towel dispensing means at said sidewall.

6. The refuse container of claim 5 wherein means for dispensing a source of fluid is borne by the sidewall and disposed in the internal cavity and including means for supporting said fluid dispensing means at said sidewall.

7. A refuse container for securing a replaceable bag in a predetermined operative attitude comprising:

a vessel having a sidewall which defines an internal cavity, and a mouth;

means for puncturing the replaceable bag borne by the sidewall and disposed in close proximity to the mouth, the puncturing means securing the bag in a predetermined operative attitude relative to the internal cavity, said puncturing means including an opening formed in the sidewall and which communicates with the internal cavity, the opening defined by a peripheral edge having top and bottom portions, a substantially wedge shaped puncturing member defined by the top portion of the peripheral edge and disposed in substantially the same plane as the sidewall, the bottom portion of the peripheral edge defining a restraining member positioned in close proximity to the puncturing member and disposed in substantially the same plane as the sidewall, a first opening formed in the sidewall, means for dispensing a source of paper towels supported by the refuse container and disposed in the internal cavity, the dispensing means positioned in dispensing relation to the first opening, a second opening formed in the sidewall, means for dispensing a source of fluid supported by the sidewall and disposed in the internal cavity, the fluid dispensing means positioned in fluid dispensing relation relative to the second opening, and an interior wall dividing the internal cavity into first and second portions, the first portion including the paper towel dispensing means, and the fluid dispensing means, and the second portion operable to receive the replaceable bag, and the interior wall including a deflector which is operable substantially to restrict access to the first portion and to deflect refuse into the second portion.

8. The refuse container of claim 7 wherein the refuse container includes a cover having an opening formed therein, the cover operable substantially to occlude the mouth of the vessel, and the opening in the cover disposed in an attitude whereby refuse moving through the opening of the cover is directed into the second portion of the internal cavity.

9. The refuse container of claim 8 wherein the restraining member is moveable out of the plane of the sidewall thereby permitting the replaceable bag to engage the puncturing member, and when disposed in the plane of the sidewall substantially inhibiting disengagement of the replaceable bag from the puncturing member.

10. A refuse container for securing a replaceable bag and wherein the refuse container includes a substantially vertically disposed sidewall defining a mouth portion, and an internal cavity, the refuse container comprising;

an interior wall disposed in the internal cavity and dividing the internal cavity into first and second portions, the interior wall restricting access to the first portion;

means for dispensing paper towels disposed in the first portion of the internal cavity, means for supporting said paper towel dispensing means at said sidewall;

means for dispensing fluid disposed in the first portion of the internal cavity, means for supporting said fluid dispensing means at said sidewall; and means for puncturing the replaceable bag borne by the sidewall and disposed in close proximity to the mouth of the refuse container, the puncturing means including an opening formed in the sidewall and defining a puncturing member, said opening including an edge defining spaced top and bottom portions and opposed, spaced apart end portions and a resiliently moveable restraining member, the puncturing member and the restraining member extending one from the top edge portion and the other from the bottom edge portion and both spaced inwardly from the opposed end portions, and both of said puncturing member and said restraining member disposed in the same plane as the sidewall, and the restraining member selectively moveable out of the plane of said sidewall thereby permitting the puncturing member to pierce the replaceable bag, the restraining member upon returning to a position substantially in the plane of the sidewall operable to inhibit movement of the replaceable bag away from the puncturing member.

11. The refuse container of claim 10 wherein the puncturing member has an apex, and the restraining member has a channel formed therein, the apex of puncturing member disposed in the channel of restraining member.

12. The refuse container of claim 11 wherein the refuse container includes a removeable cover with an opening formed therein, the cover occluding the internal cavity, and the opening of the cover disposed in an attitude whereby refuse passing through the opening of the cover is channeled into the second portion of the internal cavity.

13. The apparatus of claim 12 wherein the interior wall is operable to deflect refuse into the second portion of the internal cavity, and the paper towel dispensing means and fluid dispensing means are integral with the interior wall.

14. The apparatus of claim 13 wherein the refuse container has a longitudinal axis and the opening formed in the cover is disposed in non-coaxial alignment with the longitudinal axis.

15. The apparatus of claim 14 wherein the refuse container includes at least two puncturing means constructed and arranged as set forth in claim 10 and disposed in substantially equally spaced positions about the sidewall of the refuse container, and the cover of the container covers the individual puncturing means when the cover is disposed in fitted receipt with the sidewall.

* * * * *